US006304003B1

(12) United States Patent
Rathmann et al.

(10) Patent No.: US 6,304,003 B1
(45) Date of Patent: Oct. 16, 2001

(54) LOCKING DEVICE, IN PARTICULAR FOR A VEHICLE

(75) Inventors: Klaus-Peter Rathmann, Frankfurt; Axel Schäfer, Kriftel; Erhard Franz; Peter Kleinmichel, both of Neu-Isenburg, all of (DE)

(73) Assignee: Mannesmann VDO AG (DE)

( * ) Notice: Subject to any disclaimer, the term of this patent is extended or adjusted under 35 U.S.C. 154(b) by 0 days.

(21) Appl. No.: 09/316,873

(22) Filed: May 21, 1999

(30) Foreign Application Priority Data

May 26, 1998 (DE) ..... 198 23 345
Apr. 20, 1999 (DE) ..... 199 17 789

(51) Int. Cl.[7] ..... E05C 3/02

(52) U.S. Cl. ..... 307/10.1; 307/10.2; 49/118; 70/204; 180/287

(58) Field of Search ..... 307/10.11, 10.2, 307/10.5; 70/264; 49/118; 180/287

(56) References Cited

U.S. PATENT DOCUMENTS 5,240,296 8/1993 Kobayashi ..... 292/201
5,359,884 * 11/1994 Fey et al. ..... 73/118.1
5,878,610 * 3/1999 Friedrich ..... 70/264
5,965,953 * 11/1999 Ikeda et al. ..... 307/10.2
6,032,416 * 3/2000 Springer et al. ..... 49/18

FOREIGN PATENT DOCUMENTS

001213U1 12/1995 (AT) ..... E05B/47/00
3941086 12/1989 (DE) ..... H03M/1/22
19508026 3/1995 (DE) ..... E05B/65/36
29503683 4/1995 (DE) .
19526227 7/1995 (DE) ..... E05B/65/32
2318610 4/1998 (GB) ..... E05B/47/00

* cited by examiner

*Primary Examiner*—Albert W. Paladini
(74) *Attorney, Agent, or Firm*—Robert J. Depke; Mayer, Brown & Platt

(57) ABSTRACT

The invention relates to a locking device, in particular for a door, a tailgate, a trunk lid or the like of a vehicle, with at least one actuating drive which is capable of being activated in order to set functions of the locking device and which is operatively connected to an element of the locking device via at least one transmission element, according to the invention means being provided which detect the continuous movements and functional positions of the actuating drive or of the transmission element.

11 Claims, 3 Drawing Sheets

LOCKING DEVICE, IN PARTICULAR FOR A VEHICLE

BACKGROUND OF THE INVENTION

The invention relates to a locking device, in particular for a door or the like of a vehicle, according to the features of the preamble of patent claim 1.

DE 197 39 340.3 discloses a locking device which is used, in particular, for a door, a trunk lid or a tailgate or the like of a vehicle. Here, an actuating drive is provided, which transmits its movement, via a transmission element, to an element of the locking device, various functional positions of the locking device, such as a theft protection position, central locking position, etc., being set, depending on the movement of the actuating drive. Although DE 197 39 340.3 describes the operative connection of the actuating drive to the element of the locking device via the transmission element, no indications as to the activation of the actuating drive or transmission element and as to the detection of their positions can be gathered from this patent application.

The object on which the invention is based, therefore, is to provide a locking device which specifies not only the implementation of the functional positions, but also the activation of the actuating drive and the execution of activation.

BRIEF SUMMARY OF THE INVENTION

According to the invention, therefore, means are provided which detect the continuous movement and the functional positions (if appropriate, also the assumption of the functional positions) of the actuating drive or of the transmission element. This ensures that the actuating drive is activated from one functional position so as to assume a further functional position, for which purpose the continuous movement and the assumption of a subsequent functional position are detected, in order then to activate the actuating drive in such a way that the subsequent desired functional position is assumed and maintained. An initial position may, for example, be the theft protection position which was assumed after the vehicle was parked and secured. If, then, the vehicle is to be operated, it is necessary to change the locking device from the theft protection position to the central unlocking position by the activation of the actuating drive, so that the side door can be opened from outside. In this case, the actuating drive may also be activated in such a way that one functional position or a plurality of functional positions are skipped. Furthermore, the advantage of detecting the continuous movement is that it is possible, at any time, to have evidence as to the functional position and also the intermediate position which the actuating drive or the transmission element has assumed, so that a plausibility check can be conducted on the basis of the detected position.

In a development of the invention, the detection means comprise a potentiometer having a slider which is connected to the actuating drive or the transmission element and which travels along a resistance track, depending on the movement of the actuating drive or transmission element, the potentiometer being electrically connected in such a way that it generates a signal representing the continuous movement. The use of a potentiometer makes it possible to detect the continuous movement in a simple way, such a potentiometer emitting an essentially linear output signal, so that, in any functional position or else in any intermediate position, there are signals different from one another, which can be used for position detection or else for a plausibility check.

In a development of the invention, the means have a switching device possessing a slider which is connected to the actuating drive or the transmission element and which travels over a plurality of contact faces, depending on the movement of the actuating drive or transmission element, the switching device being electrically connected in such a way that it emits a signal whenever a functional position (or a functional position range) of the locking device is assumed. Whilst, in this case, there is provision for a signal to be emitted whenever a functional position of the locking device is assumed and for no signal to be emitted in the positions between the functional positions, the opposite procedure may also be envisaged. That is to say, no signal is emitted whenever a functional position is assumed and a signal is emitted in an intermediate position. By means of the output signal from the switching device, it can thus be detected reliably when a functional position has been assumed after the activation of the actuating drive, in order than to interrupt the activation of the actuating drive.

It is particularly advantageous to combine the output signal from the potentiometer with the output signal from the switching device, so that, at any time while the actuating drive is activated or is in a functional position, it is possible to have evidence as to the range in which the actuating drive or the transmission element is located (as a result of the evaluation of the output signal from the switching device) and whether a movement of the actuating drive or transmission element takes place during activation or not (as a result of the evaluation of the output signal from the potentiometer). If there is a signal for activation and the output signal from the potentiometer does not change, with the result that either the output signal itself or its time change is evaluated, a defect is to be inferred, which may be caused, for example, by an electrical interruption in activation or else jamming of the element of the locking device. Furthermore, it is possible to conduct a plausibility check on the basis of the at least two output signals capable of being evaluated separately from one another, an emergency operation possibly being carried out, depending on predeterminable variables (for example, deviations).

Likewise, by virtue of a development of the invention, it is particularly advantageous that, for the superposed activation of the actuating drive, the signal from the potentiometer can be evaluated when, after the actuating drive is activated for the assumption of a functional position, it is just before the latter is assumed. This means that, starting from a first functional position, the actuating drive is activated in order to assume the subsequent functional position. This takes place, for example, by means of a signal which causes rotational movements of the actuating drive. When it is established by means of the switching device, then, that it is just before the assumption of the functional position to be assumed or the latter is already assumed, the activation of the actuating drive is superposed, by the evaluation of the output signal from the potentiometer, in such a way that the activating signal for the actuating drive is not cut off abruptly, but is cut back to a minimum value or to zero within a predetermined timespan, in order thereby to avoid overshooting which could even result in the activated functional position being relinquished. It must be remembered, where appropriate, that, after the output signal from the potentiometer has been evaluated, the sign of the activating signal for the actuating drive is reversed, thus resulting in a polarity reversal of the actuating drive, in order to allow very rapid braking and, consequently, a reliable assumption of the desired functional position.

Conversely to this, it is also possible to evaluate the output signal from the potentiometer in order to detect the assumption of a functional position when the output signal from the potentiometer is within predetermined value ranges. At the commencement of the assumption of such a value range, the activating signal for the actuating drive can be reduced, for example in order to reduce the rotational speed of the actuating drive; if it has then been detected by means of the switching device that the desired functional position has been assumed, the activating signal for the actuating drive can be further reduced or cut off, thus likewise avoiding overshoots and the resulting repositioning or reactivation.

In a development of the invention, a communal slider is provided for the potentiometer and the switching device, said slider carrying pickups in each case for the resistance track and the contact faces, the pickups being electrically separated from one another, so that the output signals from the potentiometer and from the switching device do not influence one another. Here, particularly in a rotary design of potentiometer and switching devices (linear may also be envisaged), an especially compact form of construction is provided, which is particularly important in locking devices installed in doors or the like of vehicles, since there is not sufficient construction space available here.

In a development of the invention, the at least one resistance track and the contact faces are arranged on a printed board concentrically around a shaft of the actuating drive or a shaft of the transmission element. Thus, the at least one resistance track and the contact faces can be arranged on the printed track on the basis of the predetermined geometries and the available construction space, the advantage of the concentric arrangement also being that the construction space is optimally utilized thereby.

In a development of the invention, the transmission element is designed as a contoured driving disk for setting the functional positions of the locking device. The design of the contoured driving disk is illustrated in DE 197 39 340.3. In combination with the printed board, the flat driving disk has the advantage that, because of the flat design, an altogether very flat form of construction of the locking device is also obtained, so that, in turn, the construction space available within the door, tailgate or the like is optimally utilized. Furthermore, on account of the flat form of construction, there is freedom of design, since existing locking devices can be exchanged for the locking device according to the invention.

In a development of the invention, at least the actuating drive and the transmission element are arranged in a housing, the printed board being insertable into the housing. It is thus possible, by inserting, when appropriate, printed boards of different types, having different forms with resistance tracks and contact faces, to adapt their design to the contours of the driving disk.

In a development of the invention, at least the actuating drive and the transmission element are arranged in a housing, at least the resistance track and/or the contact faces being arranged inside on the housing. The advantage of this embodiment is that the printed board may be dispensed with, since its function is performed by the interior of the housing (in particular, one half of the latter). Moreover, in such an embodiment, there is no need to insert the printed board, thus reducing the production of the locking device by one production step. This is expedient, in particular, when the slider(s) for the resistance track and/or the contact faces are/is already connected to a transmission element or form a structural unit with the latter.

In a development of the invention, the printed board has electrical connections at least for the potentiometer and the switching device and, if appropriate, for the actuating drive. The integration of preferably all the resistance tracks and contact tracks which may be affixed to the printed board on one side or, in part, on two sides, increases the ease of assembly and also assembly reliability, since there is no longer any need to connect individual elements to one another via cables or the like. Since the soldering of cables to contact tracks or resistance tracks may also entail errors, one source of errors is thus effectively ruled out. Furthermore, the printed board may also carry or receive a plug or the like, by means of which the electrical components within the housing of the locking device can be connected to the outside world. By means of such a plug or the like, the locking device is connected to a central control unit, for example via a bus or other cable.

DESCRIPTION OF THE DRAWINGS

An exemplary embodiment of the locking device according to the invention is described below and is explained by means of the figures, although the invention is not restricted to this embodiment.

In the Figures.

DETAILED DESCRIPTION OF THE INVENTION

Figure 1:
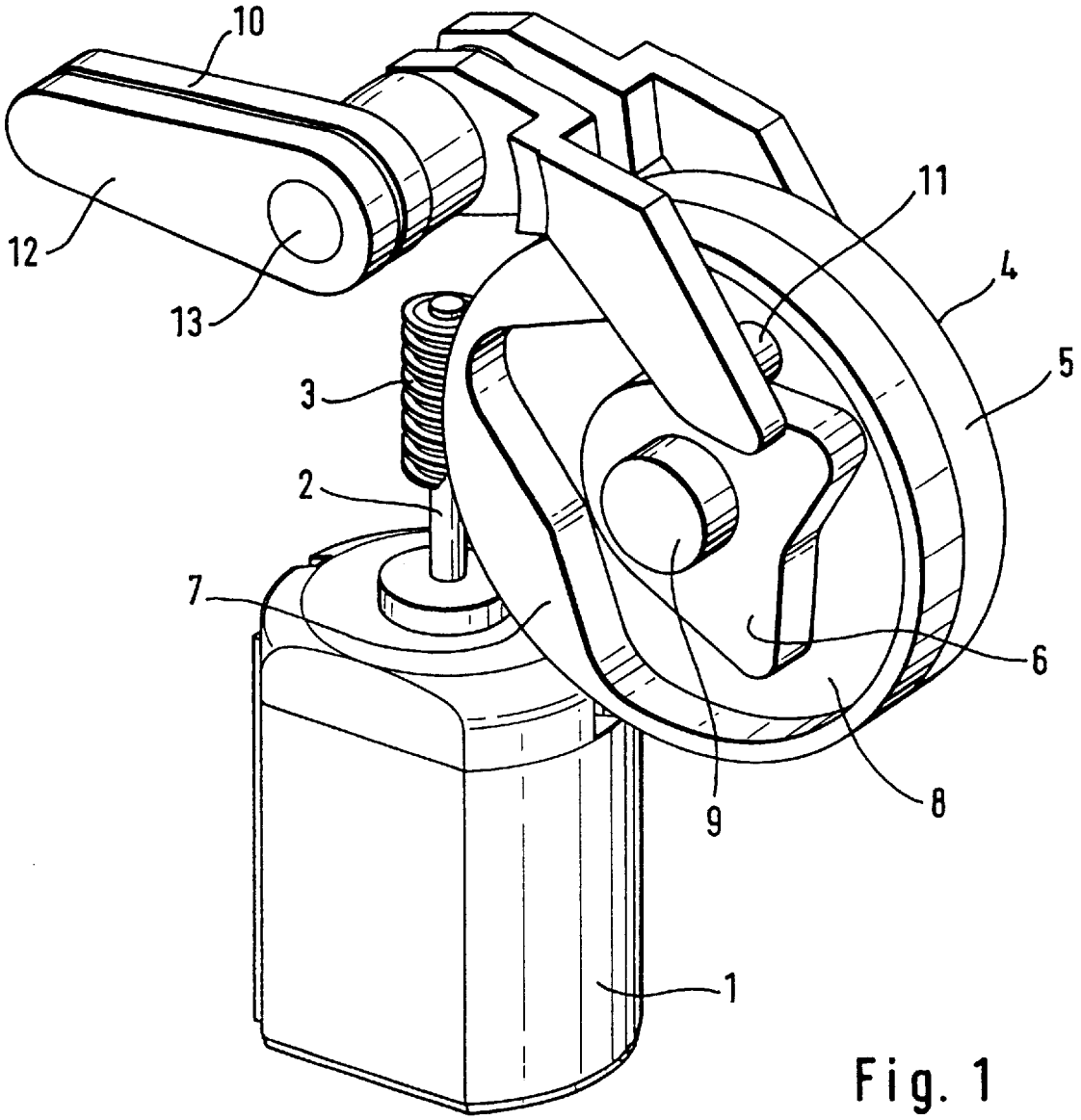
FIG. 1 shows an embodiment of a locking device.

FIG. 1 shows a locking device, also called an electrically actuable lock, with an actuating drive which is designed as an electric motor 1. A wormwheel 3 is seated on a shaft 2 of the electric motor 1, a transmission element designed as a driving disk 4 being driven by the electric motor 1. An outer circumference 5 of the driving disk 4 is provided with teeth (not illustrated in FIG. 1) which mesh with the wormwheel 3 and thus form a reduction gear. At lest one side of the driving disk 4 has inner elevations 6 and outer elevations 7 which form an intermediate region. The inner and outer elevations 6, 7 form a contoured profile for setting various functions of the lock, as also described later. The driving disk 4 is mounted rotatably on a shaft 9. The reference numeral 10 designates a first lever, of which the end assigned to the driving disk 4 carries a stud 11 which projects into the intermediate region 8 and can come to bear on the contours of the inner elevations 6 and outer elevations 7. Furthermore, FIG. 1 also shows a second lever 12 which is mounted on a common shaft 13 with the first lever 10 and can be set, independently of the first lever 10, by means of inner elevations and outer elevations on the other side of the driving disk 4. It may be mentioned, at this juncture, that, in the embodiment shown in FIG. 1, the actuation of the door interior handle and of the door exterior handle may or may not be transmitted to lock elements, such as, for example, a detent paw/rotary latch, depending on the positions of the levers 10 and 12. It may also be envisaged for an individual handle (such as, for example, the door interior handle) to be assigned its own electric motor 1 with its own driving disk 4 and inner elevations 6 and outer elevations 7 on only one side and also with only a single lever. Since the design of the lock elements does not affect the design of the actuating drive, an illustration has been dispensed with. It may be mentioned, for the sake of clarity, that the handle is connected via Bowden cables to a further lever, this further lever being actuable, for example, by the first lever 10. The further lever acts on lock elements, such as, for example, on the detent pawl cooperating with a rotary latch. In one position, the first lever 10 then ensures that the further lever can act on the detent pawl when the handle is actuated, whilst, in its other position, the first lever 10 acts on the further lever in such a way that the actuation of the handle cannot act on the detent pawl (idle stroke).

This embodiment shown in FIG. 1 therefore makes it possible to have an extremely flat form of construction which allows all the functions of an electrically actuable lock, such as unlocking, locking and theft protection (if appropriate, also child protection). The lock functions for two handles (such as, for example, the door interior and exterior handles) are performed by means of only one actuating drive (electric motor 1) by virtue of a corresponding activation of the electric motor 1 and the movement of the levers 10 and 12 according to the contours of the driving disk 4.

Figure 2:
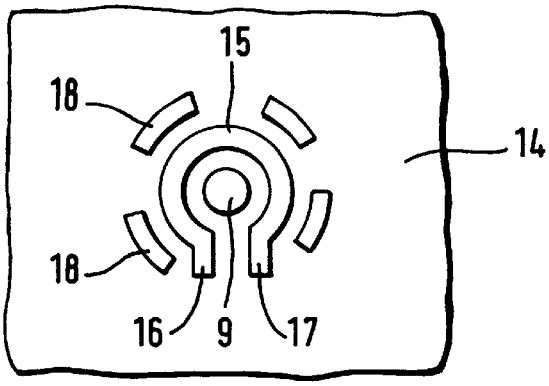
FIG. 2 shows a resistance track and contact faces on a printed board.

FIG. 2 shows a printed board 14 which can be inserted into a housing, not illustrated and not designated in any more detail, which at least also receives the electric motor 1, the driving disk 4 and the levers 10 and 12, with the housing being designed in such a way that those ends of the levers 10 and 12 which face away from the driving disk 4 project out of the housing and act on a lock element of the locking device, such as, for example, a detent pawl. The printed board 14 is provided with a bore, through which the shaft 9 is led. Arranged concentrically around this bore for the shaft 9 is a resistance track 15 which has electrical connections 16, 17 at its ends, so that this resistance track 15 can be connected to a voltage source via the electrical connections 16, 17, there being provided a slider, not shown, which is arranged on the shaft 9 and, by virtue of the type of connection, forms a voltage divider (or a variable resistor) and by means of which the output signal from the potentiometer thus formed can be picked up. The type of connection as voltage divider also has the advantage that transitional resistances are thereby eliminated and signal evaluation is improved or becomes more accurate.

Furthermore, a plurality of contact faces 18 are arranged concentrically around the bore for the shaft 9, are likewise electrically connected and are picked up by a further or the same slider on the shaft 9, so that when the slider brushes over said contact faces during the rotation of the shaft 9 and therefore of the driving disk 4, a discontinuous output signal is obtained. In this case, the arrangement of the contact faces, in particular, their part circumferences, is selected in such a way that the signals correspond to the corresponding inner elevations 6 and outer elevations 7 which form the contours of the driving disk 4.

In addition to the design of a resistance track 15 and of the contact faces 18 which is shown in FIG. 2, it may be envisaged that contact tracks are arranged concentrically, and therefore parallel, to the resistance track 15 and/or concentrically, and therefore parallel, to the contact faces 18, said contact tracks likewise having electrical connections, so that the slider travels over the resistance track 15 and an associated contact track and/or over the contact faces 18 and an associated contact track, so that the output signal is transmitted via these contact tracks to the electrical connections, not illustrated, at which the output signal from the potentiometer or switching device appears. The advantage of this is that a decrease in the output signal does not have to occur via the slider which rotates, but, instead, transmission takes place from the resistance track 15 or from the contact faces 18 via the slider to the associated contact tracks. These are likewise arranged on the same side or on the other side of the printed board 14. Furthermore, electronic components may be arranged or printed on the printed board 14. Thus, for example, resistors may be printed as an electronic component on the printed board 14.

Figure 3:
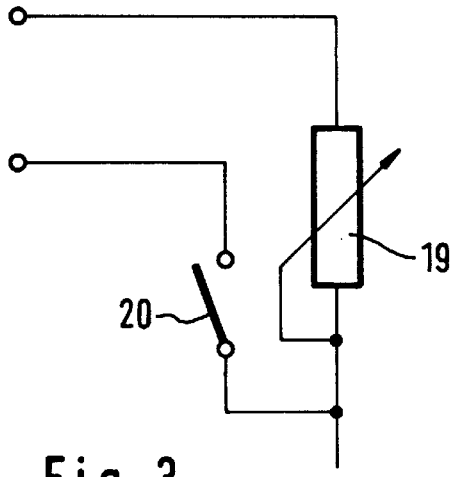
FIG. 3 shows an equivalent electric circuit diagram.

FIG. 3 shows the equivalent electric circuit diagram for the potentiometer and the switching device, the potentiometer bearing the reference numeral 19 and the switching device (switch) the reference numeral 20. The slider of the potentiometer 19 and the switch are coupled to the shaft 9, so that different signal profiles are obtained according to the rotational movement of the shaft 9 or of the driving disk 4 or of the electric motor 1. These signal profiles are explained below.

Figure 4:
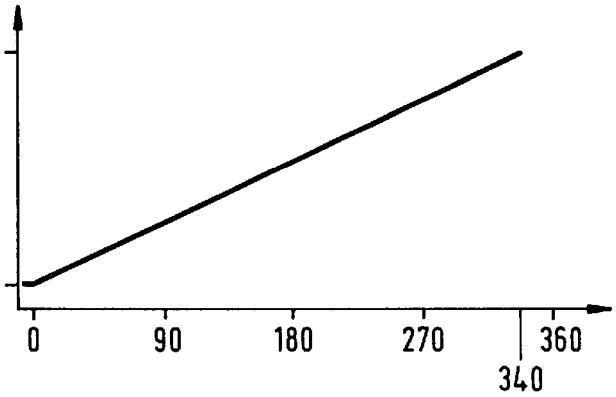
FIG. 4 shows the output characteristic of a potentiometer.

FIG. 4 shows the output characteristic of the potentiometer 19, a graduation as a function of the rotational movement, in particular of the driving disk 4, being plotted on the X-axis and the corresponding resistance value of the potentiometer 19 being plotted on the Y-axis. An essentially linearly rising characteristic is obtained, which rises from a minimum value (in particular=0) up to a maximum value which is determined by the value of the potentiometer 19 and its type of connection. The characteristic of the potentiometer 19 rises in an essentially uniformly linear manner over virtually one complete revolution of the driving disk 4, an output signal being emitted when, according to FIG. 2, the region between the two electrical connections 16, 17 is brushed over. This output signal may be used in a particularly advantageous way for evaluation, in particular for determining the reference position of the driving disk 4.

Figure 5:
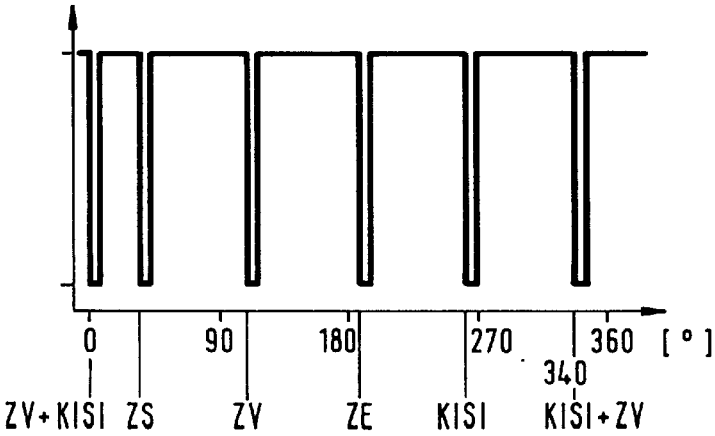
FIG. 5 shows the output characteristic of a switching device.

FIG. 5 shows the output characteristic of the switching device 20, once again the rotation of the shaft 9 or of the driving disk 4 being plotted on the X-axis and the position signal being plotted on the Y-axis. The position signal can move in digital form between a minimum value (in particular=0) and a maximum value (in particular, a supply voltage from a voltage source or somewhat below this). As shown in FIG. 5, an output signal (high or low) is generated whenever the driving disk 4 is in a functional position. As shown in FIG. 5, in the regions between the functional positions, a signal is generated (high signal), in which the switch of the switching device 20 is closed. The length of the output signals in the functional positions is selected clearly shorter than the length of the output signals in the regions between them, and it may also be envisaged to select an equal length of the output signals in the functional positions and in the intermediate regions, this becoming possible due to the fact that, in addition to the position signal, as shown in FIG. 5, the output signal from the potentiometer 19, as shown in FIG. 4, is also used to activate the actuating drive and therefore to set a functional position. In order to assume the functional positions shown in FIG. 5, the electric motor 1 can be activated in only one direction of rotation, or else also reversibly. If activation takes place in only one direction of rotation, the output signal from the potentiometer 19 (0° on the X-axis according to FIG. 4) or the output signal from the switching device 20 (0° on the X-axis according to FIG. 5) appears again after the termination of one revolution (360° on the X-axis according to FIG. 4 and FIG. 5).

FIG. 5, in addition to showing the scaling in degrees of rotation of the shaft 9 or of the driving disk 4, also shows the positions in which the functional positions are located. These positions depend on the design of the inner elevations 6 and outer elevations 7 of the driving disk 4, in the present exemplary embodiment these being selected in such a way that the different functional positions are set according to equal angles of rotation. An essentially symmetric position signal, which can be achieved by an appropriate design of the contact faces 18, is thereby obtained for the switching device 20. A part position signal (illustrated in FIG. 5 at 0° on the X-axis) deviating from this symmetry may be used to detect special positions or also to initialize the position of the electric motor 1 or of the elements driven by it.

The functional positions also additionally plotted on the X-axis in FIG. 5 have the following meanings:

ZS: central securing position (theft protection position),

ZV: central locking position,

ZE: central unlocking position,

KISI: child protection position.

In addition to the functional positions mentioned, others may be added, or some of the functions mentioned may be omitted. This depends on the vehicle door or tailgate or trunk lid on which the locking device is used. Thus, for example, the child protection position may be dispensed with on the front doors or else on the tailgate or the trunk lid. This means, for the position signal from the switching device 20, that, with regard to FIG. 5, no interruption in the position signal occurs in the range of about 270°, this being achieved by a corresponding prolongation of the associated contact face 18 according to FIG. 2.

Figure 6:
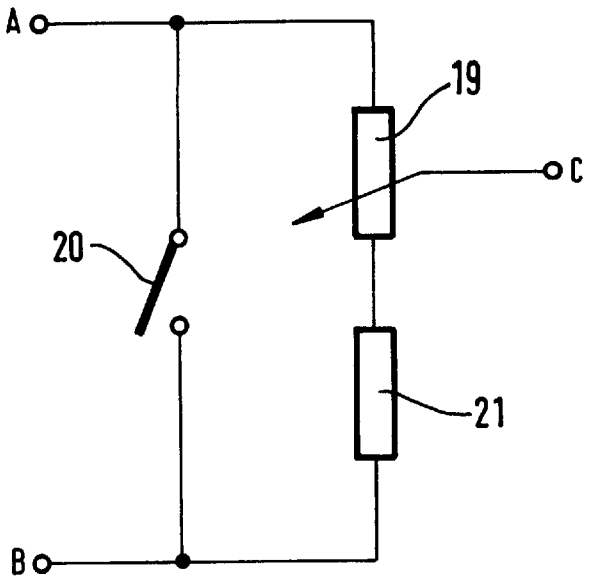
FIG. 6 shows a further equivalent electric circuit diagram.
Figure 7:
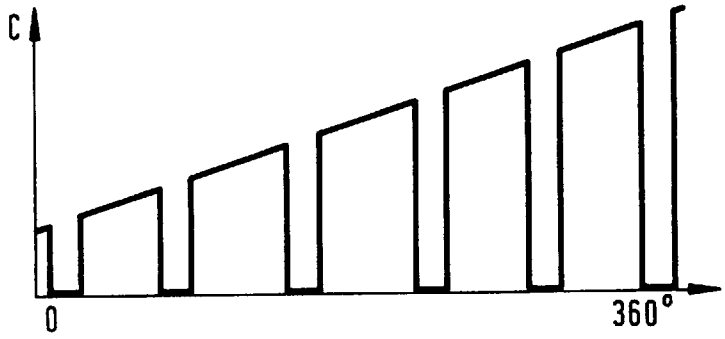
FIG. 7 shows the output characteristic of the potentiometer according to FIG. 6.
Figure 8:
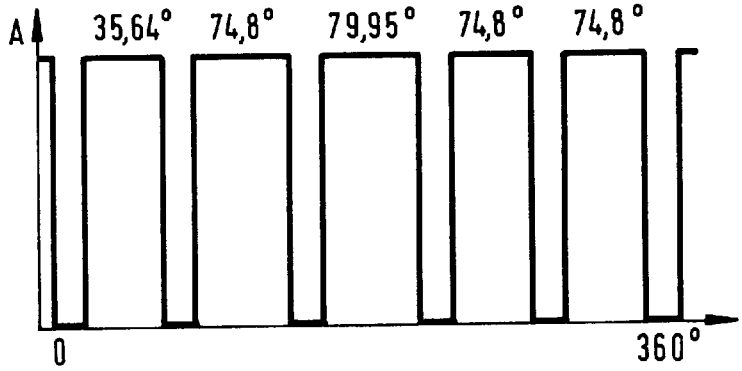
FIG. 8 shows the output characteristic of the switching device according to FIG. 6.

FIG. 6 shows another equivalent electric circuit diagram, in which the potentiometer 19 is likewise connected as a voltage divider and the switching device 20 is connected in parallel to the potentiometer 19. The switching device 20 is connected between two points A and B, point A being the current supply (reference voltage) and point B being the ground of the current supply. A digital signal for the position of the shaft 9 is therefore available at point A or point B. At point C, an analog signal for the position of the shaft 9 can be picked up on the potentiometer 19 which is also preceded by a dropping resistor 21. The output signals obtained at points A and C as a result of the equivalent circuit diagram shown in FIG. 6 are shown in FIGS. 7 and 8.

What is claimed is:

1. A locking mechanism comprising:

a drive mechanism;

a transmission element; and a locking mechanism, wherein the drive mechanism rotates the transmission element and the transmission element has a plurality of functional positions each of which corresponds to a condition of the locking mechanism, and further comprising a means for detecting the functional position of the transmission element and wherein the transmission element may be continuously rotated to repeatedly change functional positions of the transmission element.

2. The locking mechanism as claimed in claim 1, wherein the means for detecting comprises a potentiometer having a slider connected to the actuating drive or transmission element.

3. The locking mechanism as claimed in claim 2, wherein the potentiometer further comprises at least one resistance track arranged on a print circuit board around a shaft of the transmission element.

4. The locking mechanism as claimed in claim 2, further comprising means for evaluating an output signal from the potentiometer and for adjusting the drive mechanism based on this evaluation.

5. The locking mechanism of claim 3, wherein the transmission element is a contoured driving disk.

6. The locking mechanism of claim 3, wherein the printed circuit board further comprises electrical connections for the potentiometer and switching element.

7. The locking mechanism as claimed in claim 1, further comprising a switching element which outputs an electrical signal whenever a functional position is assumed.

8. The locking mechanism as claimed in claim 7, further comprising a common slider associated with the switching element and the means for detecting.

9. The locking mechanism as claimed in claim 3, further comprising means for evaluating an output from the switching element and for adjusting the drive mechanism subsequent to this evaluation.

10. The locking device as claimed in claim 7, wherein the output signal from the switching device (20) can be evaluated, for the superposed activation of the actuating drive, when, after the actuating drive is activated in order to assume a functional position, it is just before the latter is assumed, for which purpose the output signal from the potentiometer (19) can be evaluated.

11. The locking mechanism of claim 1, wherein the drive mechanism and transmission element are located within a common housing.

* * * * *